US007446255B2

(12) United States Patent
Yamaya

(10) Patent No.: US 7,446,255 B2
(45) Date of Patent: Nov. 4, 2008

(54) METHOD OF PROCESSING SOUNDS FROM STRINGED INSTRUMENT AND PICKUP DEVICE FOR THE SAME

(76) Inventor: Kiyohiko Yamaya, 6-3-2-306, Shounandai, Fujisawa-shi, Kanagawa-ken, 252-0804 (JP)

( * ) Notice: Subject to any disclaimer, the term of this patent is extended or adjusted under 35 U.S.C. 154(b) by 0 days.

(21) Appl. No.: 11/823,414

(22) Filed: Jun. 27, 2007

(65) Prior Publication Data

US 2007/0245884 A1 Oct. 25, 2007

Related U.S. Application Data

(63) Continuation-in-part of application No. 10/690,603, filed on Oct. 23, 2003, now abandoned.

(51) Int. Cl.
*G10H 3/18* (2006.01)

(52) U.S. Cl. ..... 84/731; 84/600

(58) Field of Classification Search ..... 84/731, 84/730, 723, 36, 104, 178, 296, 600, 411 R
See application file for complete search history.

(56) References Cited

U.S. PATENT DOCUMENTS 3,725,561 A 4/1973 Paul
4,168,647 A * 9/1979 Petillo ..... 84/731
4,989,491 A * 2/1991 Baggs ..... 84/723
6,274,801 B1 * 8/2001 Wardley ..... 84/731

FOREIGN PATENT DOCUMENTS

JP 07-005883 1/1995
JP 2002-236486 8/2002

* cited by examiner

*Primary Examiner*—Walter Benson
*Assistant Examiner*—Jianchun Qin
(74) *Attorney, Agent, or Firm*—Konomi Takeshita; Taro Yaguchi

(57) ABSTRACT

It is an object of the present invention to provide a pickup device for a stringed instrument which can take a piezoelectric signal for a tone of an acoustic stringed instrument. A stringed instrument is composed of a stringed instrument main body and a sensor mechanism. The stringed instrument main body is composed of one or more strings, a vibration plate used to radiate the vibration of each string as a sound wave, and a sensor mechanism that can make pressure contact with the vibration plate of the stringed instrument main body. The sensor mechanism has fixing means configured to be secured to the stringed instrument main body and a contact sensor member tightly contacted with the vibration plate directly or via an intermediate member.

1 Claim, 17 Drawing Sheets

METHOD OF PROCESSING SOUNDS FROM STRINGED INSTRUMENT AND PICKUP DEVICE FOR THE SAME

CROSS-REFERENCE TO RELATED APPLICATIONS

This application is a Continuation-In-Part application claiming priority under 35 U.S.C. 120 from U.S. patent application Ser. No. 10/690,603, filed Oct. 23, 2003 now abandoned, entitled "Method of Processing Sounds From Stringed Instrument and Pickup Device For the Same". The entire disclosure of the aforesaid application is hereby incorporated by reference herein.

BACKGROUND OF THE INVENTION

1. Field of the Invention

The present invention relates to a pickup device for an acoustic stringed instrument typified by a guitar, a ukulele, a mandolin, a violin, a cello, a contrabass, a banjo, or a samisen, and more specifically, to a sound processing method and a pickup device vibration sensor for a stringed instrument which convert the vibration force of the stringed instrument into electric signals for output.

2. Description of the Related Art

Naturally, in particular, stringed instruments require an excellent pickup device which allows strings to exhibit well-balanced acoustic characteristics, which can provide favorable outputs, and which does not hinder the propagation of the vibration of the strings to the body, which is characteristic of acoustic stringed instruments.

For this purpose, to collect electrically sounds from an acoustic stringed instrument, a microphone attached to a stand was frequently used. However, the player's movement varied the distance between the microphone and the instrument or their positional relationship. This prevented sounds from being stably collected. Thus, this problem was solved by attaching the microphone to the musical instrument.

However, because of the use of the microphone, if the collected sound is amplified and outputted through a speaker in a concert hall, the sound may enter the microphone again which is attached to the instrument. In this case, the sound is fed back to cause an oscillation phenomenon called "howling". This restricts the electric expansion of sounds from the instrument (refer to Japanese Patent Laid-Open No. 2002-236486 (Abstract)).

Furthermore, devices called "pickups" are commercially available which collect sounds by using a sensor to convert the vibration of a sound source in the instrument into electric signals. The pickup device sharply reduces the ratio of external sounds to sounds from the instrument on which the pickup device is mounted. It is thus possible to reduce the magnitude of the feedback that may occur when instrument sounds are electrically expanded. The pickup device is therefore very useful in electrically expanding instrument sounds but has the problems described below.

By way of example, description will be given of a conventional technique applied to an acoustic guitar. A pickup device for such an acoustic guitar captures and converts the vibration of each string into electric signals by arranging a sensor between a saddle and a bridge which transmit the vibration of each string to a top plate. In this case, the sensor is located too close to the strings. It is thus difficult to pick up the vibration of the top plate, which is characteristic of the tone of the acoustic guitar. Consequently, many of the components of the vibration of the strings are converted into electric signals to prevent the reproduction of the attractive characteristic tone of the acoustic guitar. Furthermore, when the sensor is mounted, an expert in musical instruments must be asked to process and adjust the instrument carefully. Therefore, mounting the sensor is difficult.

Furthermore, a type of a conventional pickup device (refer to National Publication of International Patent Application No. 2002-515258 (Abstract)) is stuck to the top plate using a pressure sensitive adhesive coated tape or an adhesive. With this pickup device, picked-up sounds have certain peculiarities and the tone is thus inappropriate because the top plate has complicated vibration characteristics. Furthermore, when such a stuck type pickup device is removed, varnish may disadvantageously be released from the top plate.

Another conventional pickup device secures a piezoelectric transducer to a belly of a stringed instrument using a C-shaped clamp. The clamp in this instrument pickup assembly is attached to the exterior and the back surface of the top, vibrating belly of the instrument, near a soundhole. Thus, the transducer vibrates along with the top, vibrating plate, and it acts to pick up the corresponding vibration accelerations. This device, again, poses the problem of picking up the complicated vibration characteristics and peculiarities associated with the top plate (refer to U.S. Pat. No. 6,274,801 B1).

Thus, although pickup devices of various structures have been provided for acoustic stringed instruments, sounds reproduced by these pickup devices cannot sufficiently reproduce the attractive tone of the acoustic stringed instrument.

Furthermore, another type of a conventional acoustic guitar pickup device has a sound hole formed in the top plate and in which an electromagnetic pickup is mounted to capture and convert the vibration of the strings into electric signals.

However, this device picks up only the vibration of the strings and thus reproduces little of the attractive tone of the acoustic guitar. The tone obtained is like that of an electric guitar. Therefore, this device cannot provide the attractive tone of the acoustic guitar (refer to Japanese Patent Laid-Open No. 7-5883 (Abstract)).

Yet another example of an electromagnetic pickup device, this time applied to either a drum or a guitar, attempts to control vibrations by converting vibration velocities at the vibrating surface to electrical signals. Such a device would typically aim to reduce the levels of electrical signal output, in order to achieve vibration control. Thus, again, the complicated vibration characteristics and peculiarities of the vibrating surface may result in inappropriate tones (refer to U.S. Pat. No. 3,725,561).

SUMMARY OF THE INVENTION

Generally speaking, it is an object of the present invention to provide a pickup device for a stringed instrument which generates electric signals more faithful to the attractive tone of an acoustic stringed instrument.

Specifically, the present invention focuses on the significant contribution of the vibration characteristics of a vibration plate of an acoustic stringed instrument, which is called a "top plate", "sound board", or "top board", to the attractive tone of the acoustic stringed instrument. The present invention thus provides a pickup device that picks up vibrations as a source of instrument sounds, via the vibration plate/top plate to generate electric signals more faithful to the attractive tone of the acoustic stringed instrument.

Furthermore, a moderate force is exerted to press a vibration sensor against the vibration plate/top plate of the stringed instrument. Then, a reaction vibrating force is applied to the sensor to stop the vibration at this point. This reaction vibrating force corresponds to the vibration of the strings propagating through a complicated vibration propagation path in the vibration plate to reach the point where the sensor is pressed. The reaction vibrating force contains many of the elements of the attractive tone of the acoustic stringed instrument.

It is thus another object of the present invention to provide a pickup device which uses a sensor to convert these elements into electric signals, thus generating electric signals closer to the attractive tone of the acoustic stringed instrument.

Generally speaking, the present invention is characterized by a sound processing device in which a vibration transmitter is pressure-contacted with a vibration plate/top plate in a stringed instrument main body, the vibration plate including a fingerboard, in which a sensor captures vibration of the vibration plate directly in the form of a vibrating force, and in which a pickup mechanism converts the vibrating force into electric signals. The sound processing device is characterized by being disposed on a stringed instrument main body having one or more strings and the vibration plate radiating vibration of the strings as sound waves and including the fingerboard and by comprising the vibration transmitter that can be pressure-contacted with the vibration plate of the stringed instrument main body and the pickup mechanism that transmits the vibrating force of the vibration transmitter to the sensor to convert the vibrating force into electric signals. This device and method generates electric signals faithful to the attractive tone of the acoustic stringed instrument.

The present invention is also characterized by having fixing means for fixing the vibration transmitter to the stringed instrument main body. As a result, the vibration transmitter can be mounted at and removed from an arbitrary position of the stringed instrument main body. Furthermore, the vibration transmitter is reliably secured to the stringed instrument main body and is thus prevented from slipping off the main body during performance or suffering similar accidents.

Furthermore, the fixing means preferably has a horse shoe-shaped (U-shaped) fixing member structure having two parallel members. The spacing between these members can be freely adjusted. As a result, the pickup device main body can be reliably mounted on the stringed instrument main body by using means for easily sandwiching the fixing member between shell portions of the stringed instrument main body.

Moreover, the mounting angle of the vibration transmitter can be varied in accordance with the shape of an area of the stringed instrument main body in which the vibration transmitter is mounted. As a result, the vibration transmitter can be easily and reliably secured even to a curved portion of the top plate (vibration plate) which may be present in a musical instrument such as a violin.

Furthermore, the vibration transmitter has a depressed portion formed on its surface and having a concave cross-section, and the pickup mechanism has a blastomeric projecting portion tightly fitted into the depressed portion. Consequently, the vibration can be stably transmitted utilizing surface contact over an appropriately large area, and the angles of the vibration transmitter and pickup mechanism can be freely adjusted. Moreover, the vibration transmitter is a magnetic substance or has a structure in which the magnetic substance is buried, and the vibration transmitter is attractively attached to the projecting portion of the pickup mechanism which is made of the magnetic substance so that the angle of the vibration transmitter can be adjusted. As a result, the vibration transmitter is always integrated with the pickup mechanism. Therefore, possible accidents during performance can be prevented. For example, even if the device main body is intensely vibrated during performance, the vibration transmitter is prevented from slipping off the pickup mechanism.

Furthermore, the fixing member, which is characteristic of the present invention, has a sub-adjusting member for pressure-contacting the vibration transmitter with the vibration plate of the stringed instrument main body. As a result, it is possible to fine-tune only the contact of the vibration transmitter with the device main body.

Moreover, the fixing member, which is characteristic of the present invention, has a rotative moving lever one end of which has the pickup mechanism and the other end of which is pivotally attached to the fixing member, and a portion of the rotative moving lever which is pivotally attached to the fixing member has a spring member that always pushes the rotative moving lever toward the vibration plate of the stringed instrument. As a result, the pickup mechanism is always pushed toward the vibration plate. Therefore, the pickup mechanism and the vibration plate always fit each other to enable an excellent tone to be maintained.

Furthermore, a putty member such as gypsum, various resins, or synthetic rubber which is relatively soft or is hardened as the time elapses is located between the vibration transmitter and the vibration plate of the stringed instrument main body, both of which are characteristic of the present invention. This further improves the fitting effect based on the contact of the pickup mechanism with the vibration plate.

The present invention is also characterized in that the fixing means is shaped like a horse shoe (U-shaped) and has two parallel members, and the spacing between the two parallel members can be freely adjusted.

The present invention is also characterized by a contact member of the pickup device having a blastomeric intermediate member so that a contact surface contacts parallel with the vibration plate of the stringed instrument main body.

In a sound processing method and a pickup device for a stringed instrument according to the present invention, a vibration sensor section is mounted on a fixing member of a stringed instrument such as a guitar so that the vibration speed or vibration acceleration of a vibration plate of the stringed instrument can be converted into electric signals. Therefore, the method and device are effective in representing the attractive tone of the acoustic stringed instrument.

BRIEF DESCRIPTION OF THE DRAWINGS

In the accompanying drawings, the present invention is applied to a guitar, and

DETAILED DESCRIPTION OF THE PREFERRED EMBODIMENTS

Figure 1:
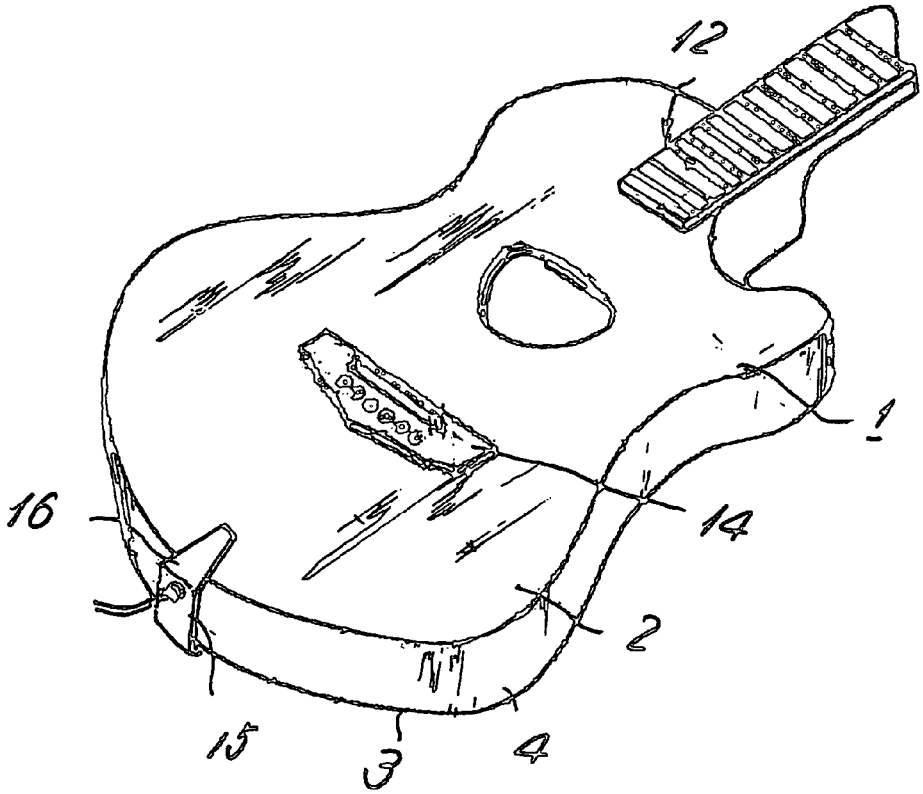
FIG. 1 is a perspective view of essential parts of a guitar main body.
Figure 2:
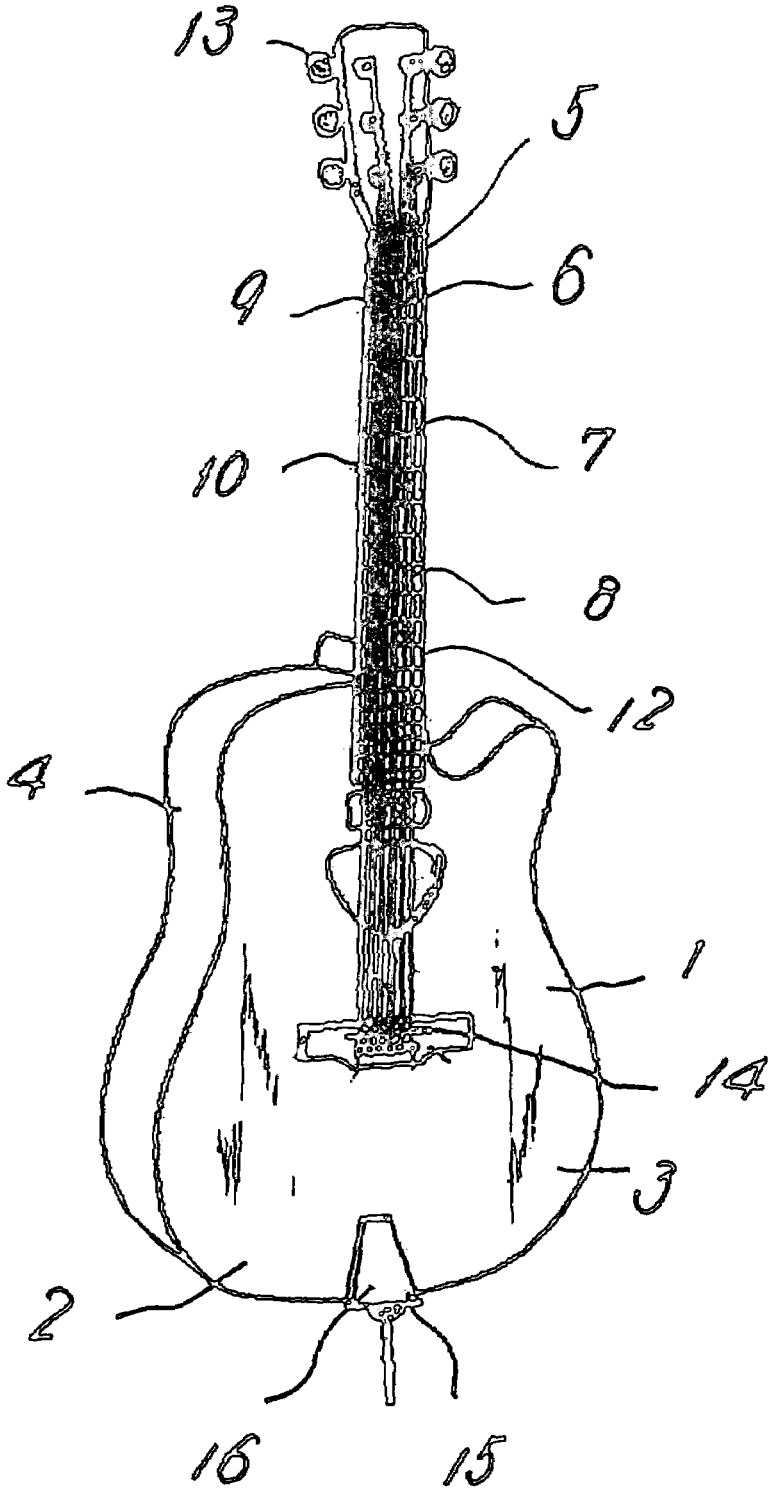
FIG. 2 is a perspective view of the whole guitar main body.
Figure 3:
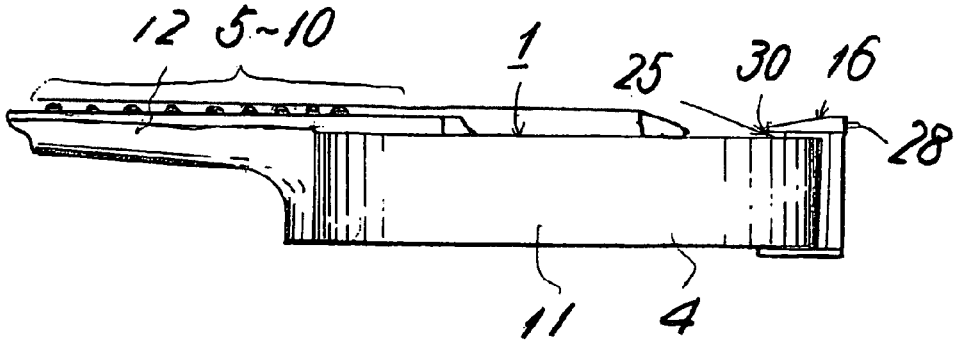
FIG. 3 is a side view of a resonant housing on which a sensor mechanism according to the present invention has been mounted.

To describe embodiments of the present invention, the inventors have selected a folk guitar as a typical acoustic stringed instrument for convenience. It is to be understood that the various embodiments of the present invention are also intended to be applicable to a wide variety of other stringed instruments, such as the violin, viola, cello, contrabass, and other musical instruments having a similar configuration.

In the figures, reference numerals (1) and (2) denote a stringed instrument main body and a vibration plate or top plate as a top shell, respectively. Reference numerals (3) and (4). denote a bottom shell, or back plate, and a side plate, respectively. Reference numerals (5), (6), (7), (8), (9), and (10) denote guitar strings. Reference numeral (11) denotes a hollow resonant housing portion that resonates with vibration sounds to amplify them.

Each of the guitar strings (5) to (10) has one end wound around a tuning bolt (13) on a neck (12) and the other end connected to and held by a bridge (14) provided on a surface of the vibration plate/top plate (2).

Acoustic guitars are classified into flat top guitars having a relatively small spacing between the guitar strings (5) to (10) and the stringed instrument main body (1) and arch top guitars having a relatively large spacing between the guitar strings (5) to (10) and the stringed instrument main body (1). The flat top guitar commonly has a bridge (14) fixed to the vibration plate/top plate (2). On the other hand, the arch top guitar commonly has a movable bridge comprising a vertically adjustable mechanism. Both types of guitars are applicable to the implementation of the present invention.

Embodiment 1

A vibration sensor mechanism (15) according to the present invention operates as described below. By way of example, the vibration sensor mechanism (15) is composed of a hook-like sensor mounting member (16) (or "sensor arm"), one side of which is folded downward and which has a screw hole (20) formed in the folded portion (17) so as to extend upward, a hook-like holding member (19) (or "back arm") one side of which is folded upward and which has a through hole (21) formed in the folded portion (18), and an adjusting screw (23) inserted upward through the through hole (21) so as to screw a thread (22) formed in the upper part of the screw, into the upper screw hole (20).

The vibration sensor mechanism (15) is U-shaped (shaped like a horse shoe) so that its tip appears to be open (24) in a side view and that the open (24) portion can be pushed and set over a tail portion of the stringed instrument main body (1).

An angle adjusting mechanism in the sensor mechanism (15) is simpler than any other types of angle adjusting mechanisms and is called a "spherical adhesion type". This type of angle adjusting mechanism utilizes spherical adhesion to achieve surface contact over an appropriate area, thus enabling vibrations to be stably transmitted. Specifically, reference numeral (25) denotes a plate-like sensor member composed of a piezoelectric element that converts physical vibrations into electric signals. The sensor member (25) is provided on a surface of a horizontal portion (26) of the holding member (16) using means such as attachment. The sensor member (25) has a blastomeric intermediate member (27) provided on its surface and projecting downward, i.e. toward the stringed instrument main body (1).

Reference numeral (30) denotes a buffer member for the blastomeric intermediate member (27) attached in position to the surface of the vibration plate/top plate (2) of the stringed instrument main body (1). The vibration transmitter (30) has a top surface that is always in contact with the blastomeric intermediate member (27) and a bottom surface that is in contact with the vibration plate/top plate (2).

Moreover, reference numeral (28) denotes an output jack that can be exposed from one side of the sensor mounting member (16) and connected to a predetermined pickup device (not shown) The jack (28) is electrically connected to the sensor member (25) via a lead (29).

Now, description will be given of means for mounting the sensor mechanism (15), an embodiment of the present invention, on the stringed instrument main body and the effects of this means.

First, the adjusting screw (23) of the sensor mechanism (15) is rotated to create a sufficient spacing between the sensor mounting member (16) and the holding member (19).

Then, the open (24) portion of the sensor mechanism (15) is inserted over a tail portion or the like of the stringed instrument main body (1). At this time, the vibration transmitter (30) is made to contact in advance with the blastomeric intermediate member (27) of the sensor mounting member (16). Then, the adjusting screw (23) is rotated in the direction opposite to the one described previously to allow the stringed instrument main body (1) to be reliably sandwiched between the sensor mounting member (16) and the holding member (19). In other words, the adjusting screw (23) is rotated to first expand, then contract, the space between the sensor mounting member (16) and the holding member (19), so that they are secured respectively to the vibration plate (2) and the back plate (3). The sensor mechanism (15) is thus secured to the stringed instrument main body (1).

When this guitar is played, sounds are generated in the resonant housing portion (11) to vibrate the vibration plate (2).

Then, this vibration is transmitted from the vibration plate (2) of the stringed instrument main body (1) to the sensor member (25) via the vibration transmitter (30) and the blastomeric intermediate member (27) of the sensor mounting member (16). The sensor member (25) converts this physical vibration into an electric signal and then transmits it to an amplifier (not shown) or the like via the output jack (28).

Thus, according to this embodiment of the present invention, a moderate force is exerted to press the sensor member (25) against the vibration plate (2) of the guitar. Thus, a reaction vibrating force is applied to the sensor member (25) to stop the vibration at this point. This reaction vibrating force corresponds to the vibration of the strings propagating through a complicated vibration propagation path in the vibration plate (2) to press the sensor member (25). The sensor member (25) can then convert the reaction vibrating force into an electric signal to be output.

The above-described arrangement contrasts with the conventional pickup devices described previously, in that the present invention aims to restrain or stop the vibration at the pressure-contact point of the vibration transmitter (30) to the vibration plate (2). By contacting the holding member (19) to the back plate (3), the present invention uses the back plate (3) which does not vibrate very much, as a base to push the sensor member (25) (vibration transmitter (30)) against the vibration plate (2).

Thus, rather than vibrating along with the vibration plate (2), the pickup device of the present invention aims to apply a reaction vibrating force, containing many of the elements of the attractive tone of the acoustic stringed instrument, to the sensor member (25). By restraining or stopping the vibration at the pressure-contact point and by applying the reaction vibrating force to the sensor, the present device attempts to generate electric signals more faithful to the attractive tone of the acoustic stringed instrument.

Embodiment 2

Figure 4A:
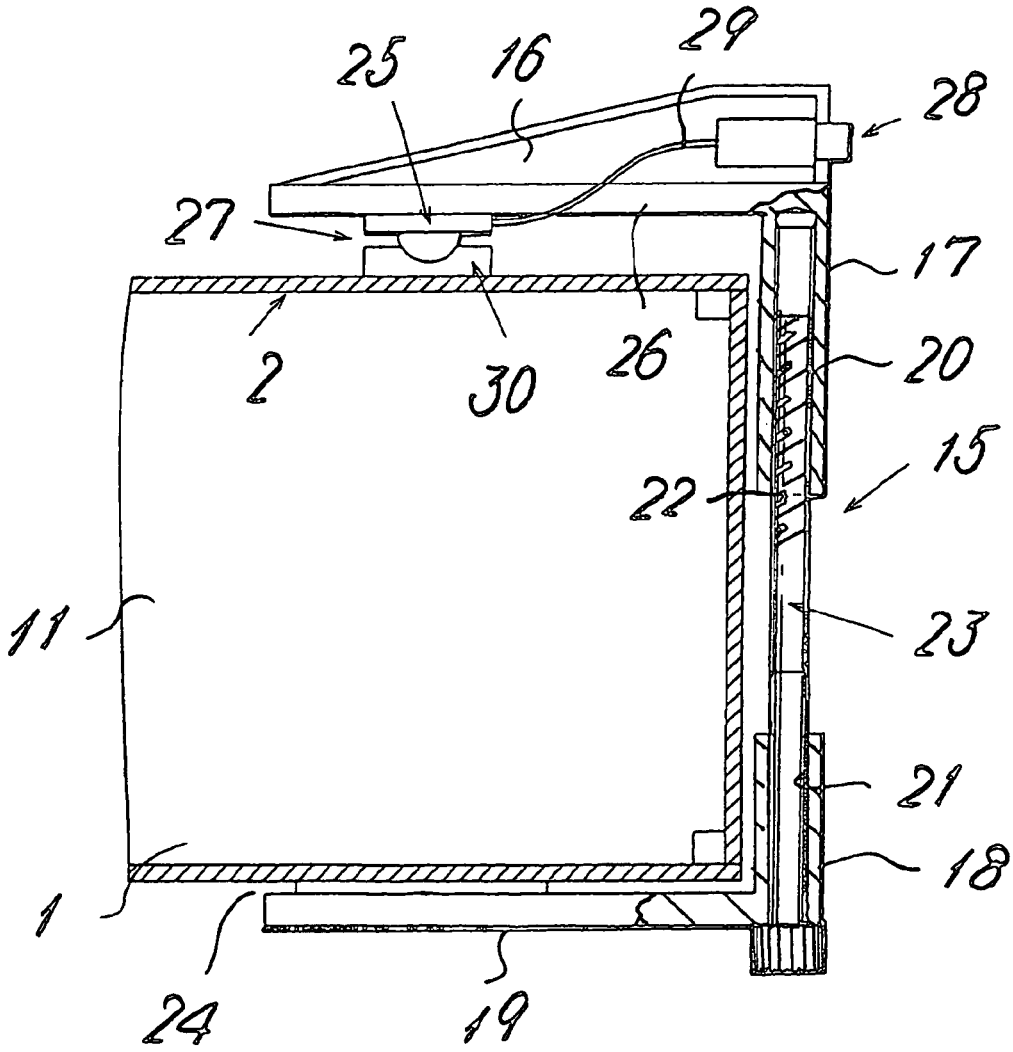
FIGS. 4A and B are vertical sectional views illustrating a resonant housing on which two embodiments of a sensor mechanism according to the present invention have been mounted.
Figure 4B:
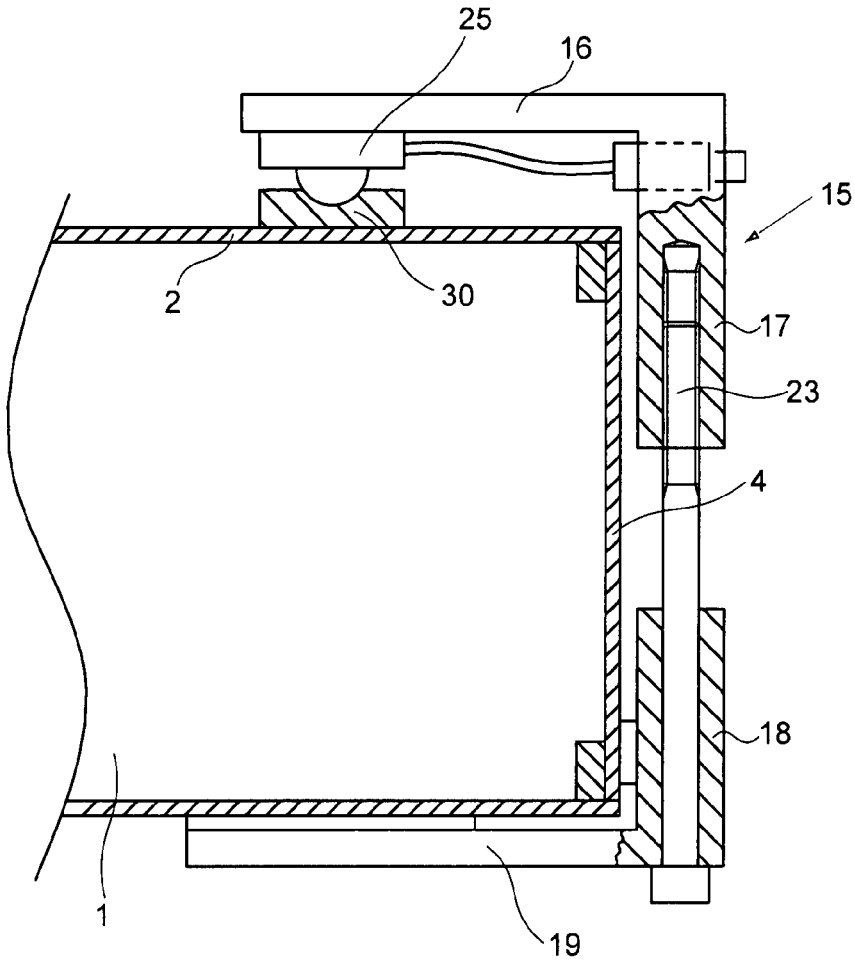

FIG. 4B shows another embodiment of the present invention, using a simpler form of the sensor mounting member (16). This illustration shows the various advantageous features of this configuration, including its simple construction and the fact that it minimizes the contact points with the musical instrument to only two contact areas. Essentially, the application of the sensor mechanism (15) to the main body (1) using pressure forces, along with the resilience of the instrument itself, maintains the pickup device on the instrument.

It should be understood that the folded portions (17, 18) of the sensor mechanism (15) may also be configured to contact and removably engage the side plate or rib (4) of the instrument. Thus, the device is engaged with the top, back and side surfaces of the main body (1) to secure the pickup device to the instrument with even greater firmness and reliability.

Embodiment 3

In the above embodiment, the vibration transmitter (30) is sandwiched between the blastomeric intermediate member (27) and the vibration plate (2). In this case, when the sensor mechanism (15) is mounted on the resonant housing portion (11) or removed from it, the vibration transmitter (30) may slip out to make the mounting difficult or may be lost.

Figure 5:
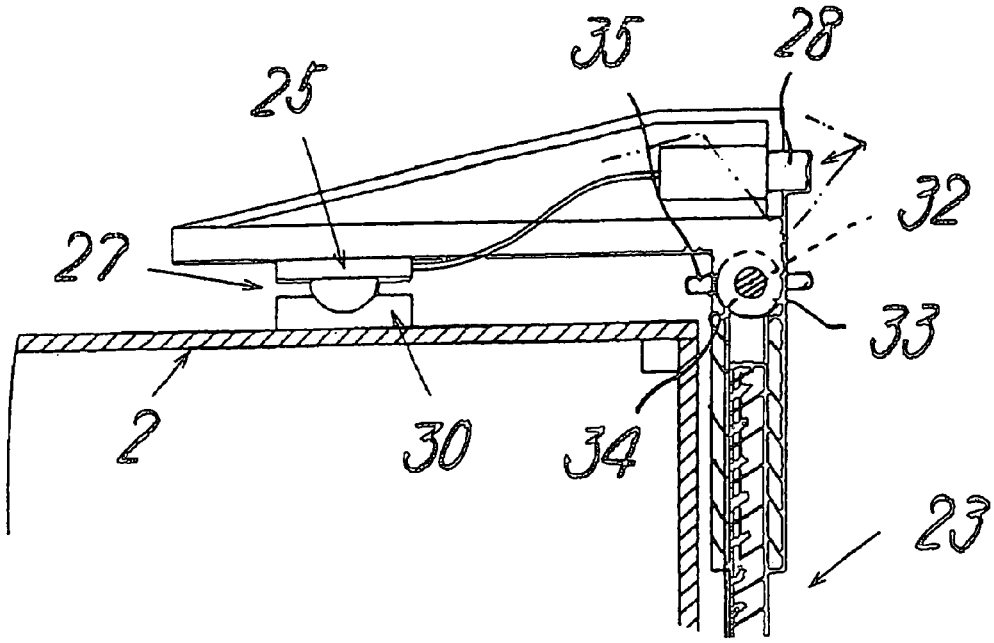
FIG. 5 is a vertical sectional view illustrating the whole fixing means with the sensor mechanism.

Thus, as shown in FIG. 5, the intermediate member (27) may be made of a magnetic material, and a permanent magnet (31) may be embedded in the vibration transmitter (30). This prevents the vibration transmitter (30) from slipping easily off the intermediate member (27) and allows their angles to be smoothly adjusted.

Embodiment 4

Figure 6:
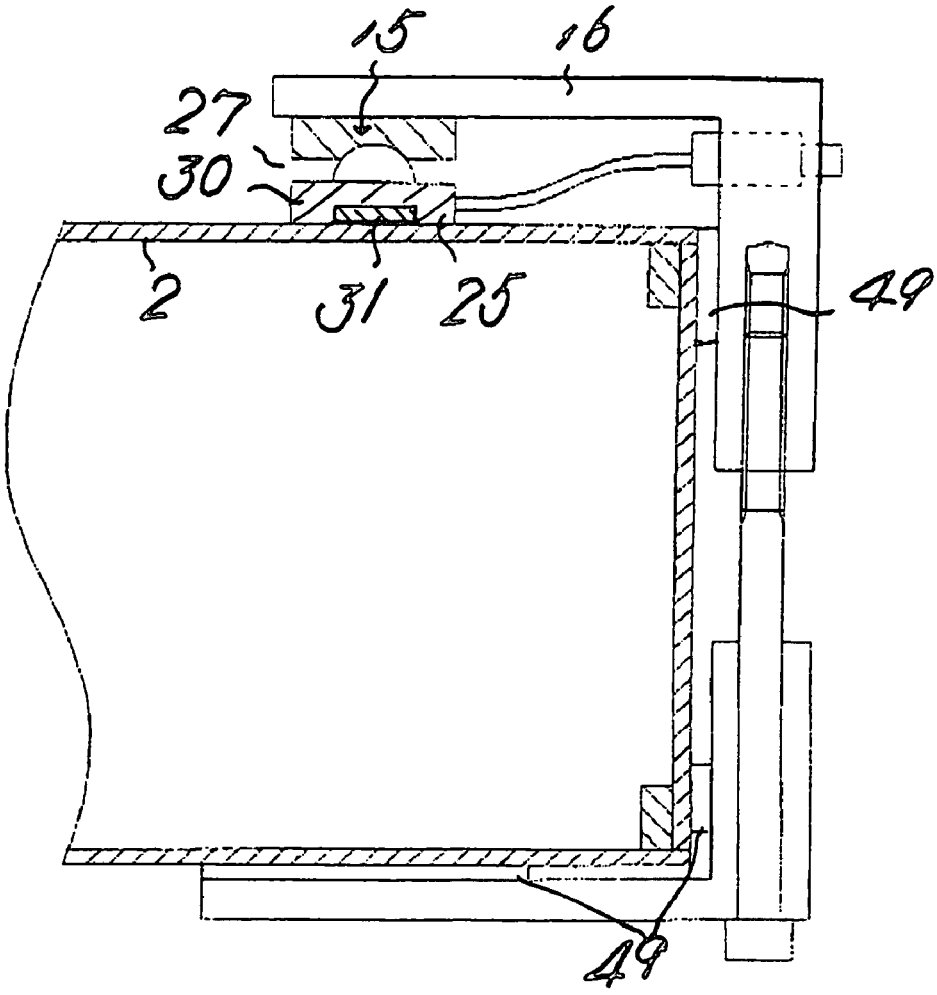
FIG. 6 is a vertical sectional view of another embodiment illustrating contacted portions of a vibration plate and the sensor mechanism.

Furthermore, in the above embodiment, the sensor member (25) is mounted on the sensor mounting member (16) of the sensor mechanism (15). However, the sensor member (25) has been found to be similarly effective even when it is mounted on the vibration plate (2) of the device main body (1) as shown in FIG. 6.

Embodiment 5

The description of the above embodiments of the present invention focuses on the guitar. However, the flat top guitar and the arch top guitar differ in their surfaces, i.e. the shapes of their vibrators. Furthermore, the front plates of the violin, cello, and contrabass have gently curved surfaces. It is difficult to secure reliably the above horse shoe-shaped sensor mechanism (15) to these instruments.

Specifically, if this pickup is mounted on a musical instrument such as a violin in which the vibration plate (2) is composed of a curved top plate, then a member in contact with the vibration plate must fit the vibration plate (2). If the musical instrument has a convex curved surface having a relatively large radius of curvature, a certain amount of the vibration can be transmitted without damaging the instrument even if the member in contact with the vibration plate has a flat contact surface.

However, if the musical instrument has a concave curved surface as in the case with the top plate of a musical instrument such as a violin and if the "member in contact with the vibration plate" has a flat contact surface, then corners of the member in contact with the vibration plate may touch and damage the vibration plate.

This problem has been solved by forming that portion of the member in contact with the vibration plate (2) which is in contact with the vibration plate (2) using a fitting material the shape of which can be varied so as to contact tightly with the above buffer member (30), which is in turn in contact with the vibration plate (2), the fitting material being subsequently hardened.

It has been found that the member in contact with the vibration plate can be contacted tightly with the vibration plate to obtain stable pickup sounds, by applying an appropriate amount of a fitting material such as epoxy putty or gypsum to the surface of the member in contact with the vibration plate, pressing the fitting material against the area in which the sensor mechanism (15) is to be mounted for shaping, hardening the fitting material, and then firmly mounting the sensor mechanism (15). A non-slipping material such as rubber may also be used, to minimize the chance of the sensor mechanism (15) slipping off the instrument. This configuration allows the adjustment of the adjusting screw (23) to a suitable tightness to hold the device on the instrument, without risking breakage of or damage to the instrument.

Figure 7:
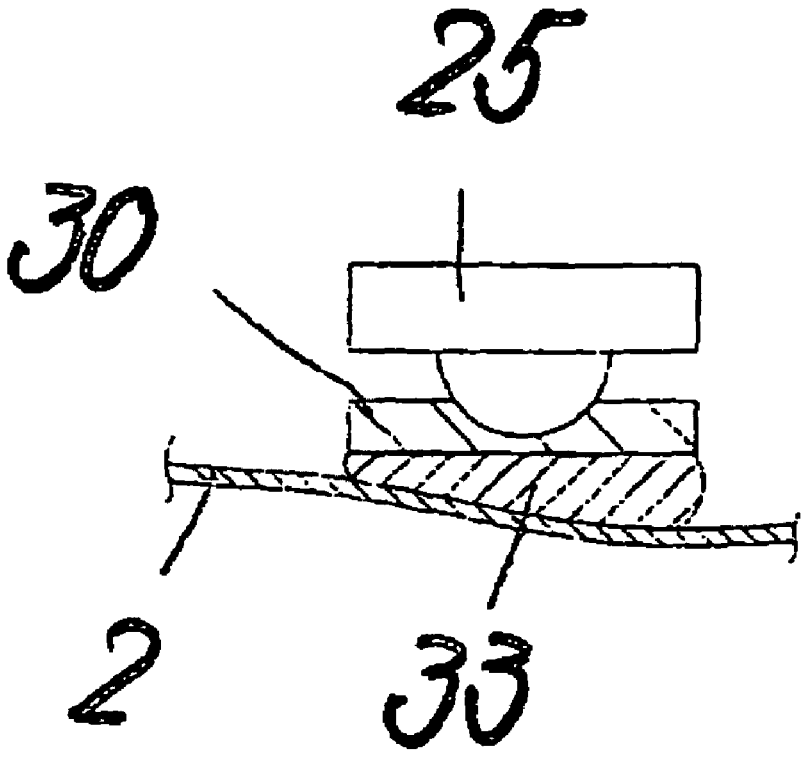
FIG. 7 is a vertical sectional view of yet another embodiment illustrating the contacted portions of the vibration plate and the sensor mechanism.

By way of example, as shown in FIG. 7, the above problems have been solved by interposing a sub-contact member (33) between the vibration transmitter (30) and the vibration plate (2), the sub-contact member (33) having a top surface that can be attached to a back surface of the buffer member (30) and having a bottom surface with the same shape as that of the vibration plate (2) of the device main body (1).

Embodiment 6

Figure 8:
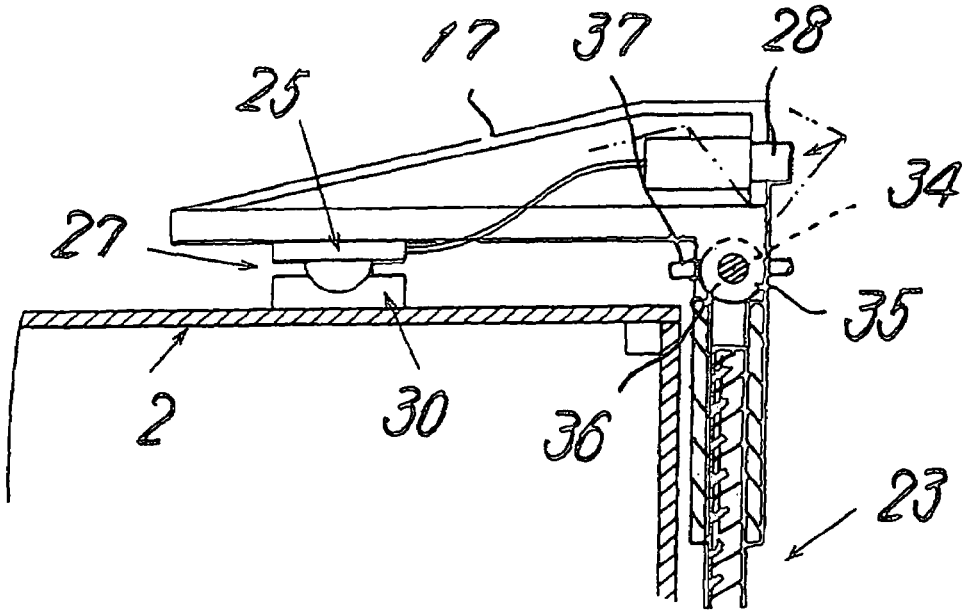
FIG. 8 is a vertical sectional view illustrating the fixing means provided with adjusting means according to further another embodiment.

Furthermore, preferably, as shown in FIG. 8, the sensor mounting member (16) constituting the sensor mechanism (15) extends flat in the horizontal direction and is constructed using a member different from that of the vertical folded portion (17) of the previously described embodiment. Moreover, preferably, the folded portion (17) and one end of the sensor mounting member (16) are pivotally attached to each other so as to be rotatively movable.

Various pivotal attaching means may be used. The illustrated pivotal attaching means comprises a hook member (34) provided under the bottom surface of the outer end of the sensor mounting member (16) and hook members (35) which are provided at the tip of the adjusting screw (23) and at the upper end of the screwed folded portion (17) and which are aligned with the hook member (34). A hinge (37) is fitted into a through hole (36) formed in each of the hook members.

Accordingly, if the surface (vibration plate (2)) is not flat, the hinges (37) are loosened to adjust the angle of the sensor mounting member (16) so that the sensor mounting member (16) fits the shape of the vibration plate (2).

Embodiment 7

Figure 9:
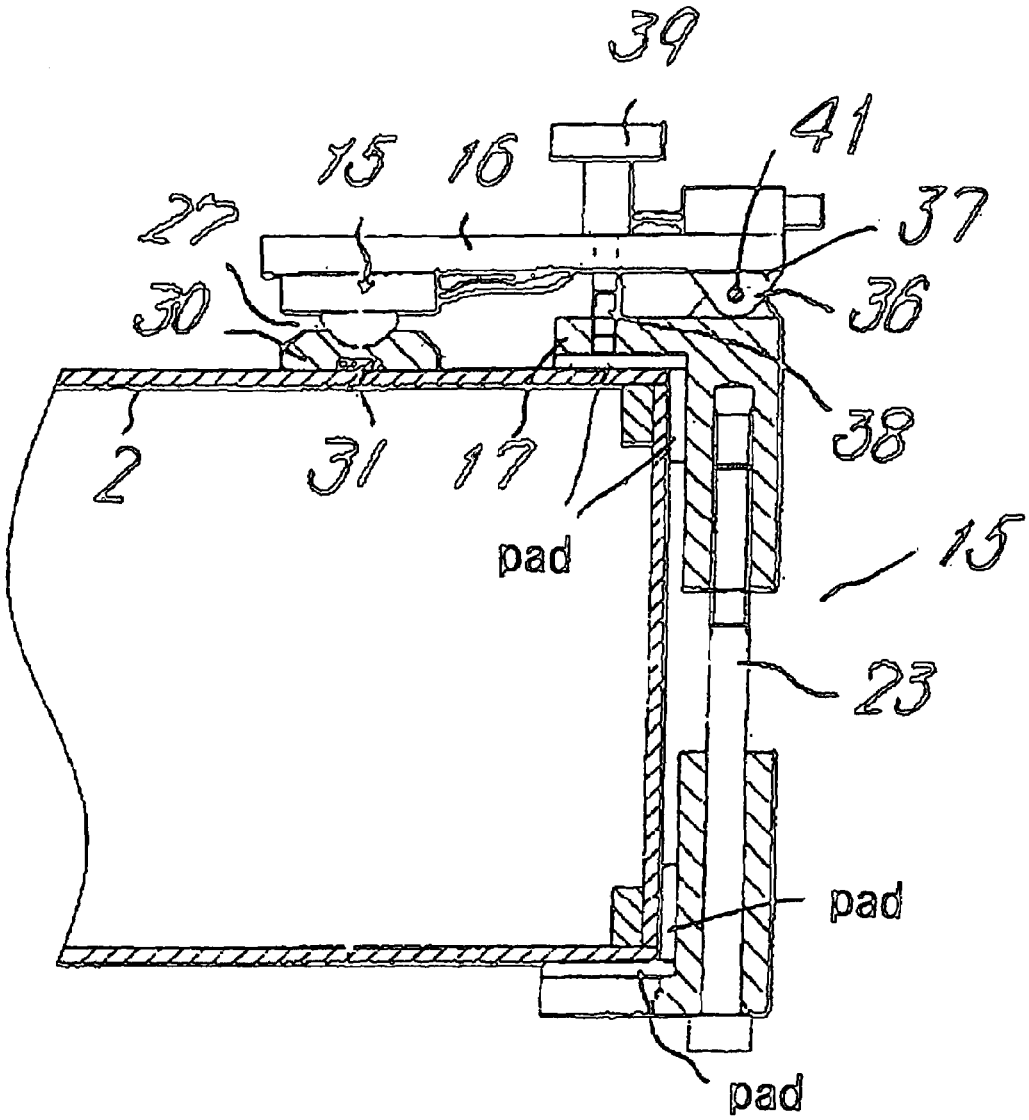
FIG. 9 is a vertical sectional view illustrating the fixing means provided with adjusting means according to further another embodiment.

The embodiment shown in FIG. 9 enables the angle of the sensor mounting member (16) to be fine-tuned compared to the embodiment shown in FIG. 9. Specifically, a sub-adjusting screw (38) is screwed into an intermediate portion of the sensor mounting member (16) of the sensor mechanism (15). The sub-adjusting screw (38) has an adjusting knob (39) provided at its top and abutted against the folded portion (17) of the fixing means according to the present embodiment.

This fixing means is fitted over the resonant housing portion (11) of the stringed instrument main body (1) by using the adjusting screws (23). Then, by rotating the sub-adjusting screw (38), it is possible to fine-tune the level of the contact of the sensor mechanism (15) with the vibration plate (2) via the vibration transmitter (30), i.e. the fitting between these components so as to obtain the best tone.

Embodiment 8

Figure 10A:
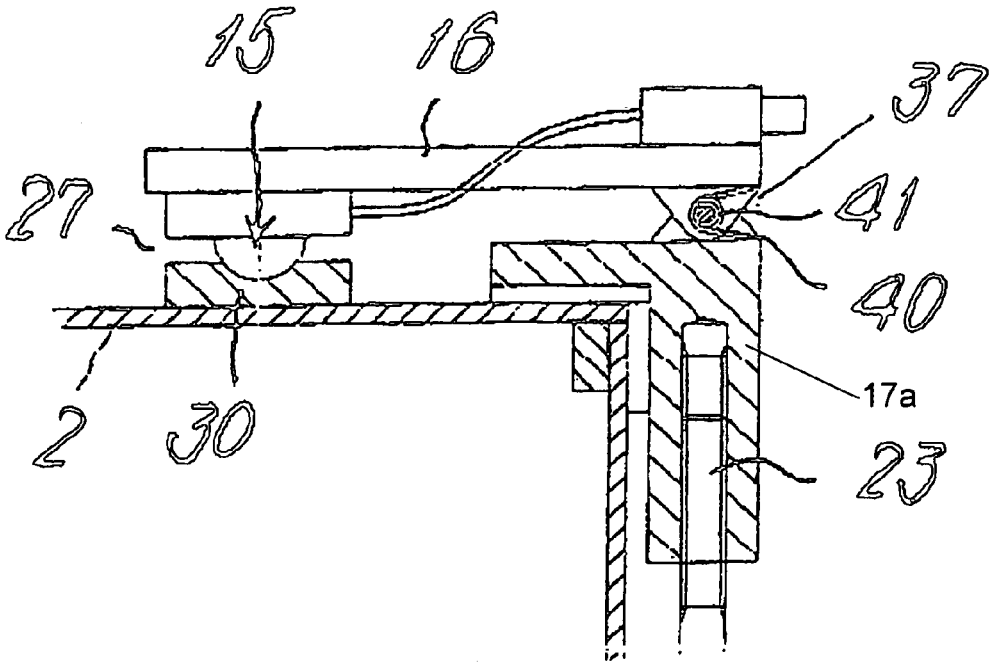
FIG. 10A is a partial vertical sectional view illustrating the fixing means provided with adjusting means according to another further embodiment.
Figure 10B:
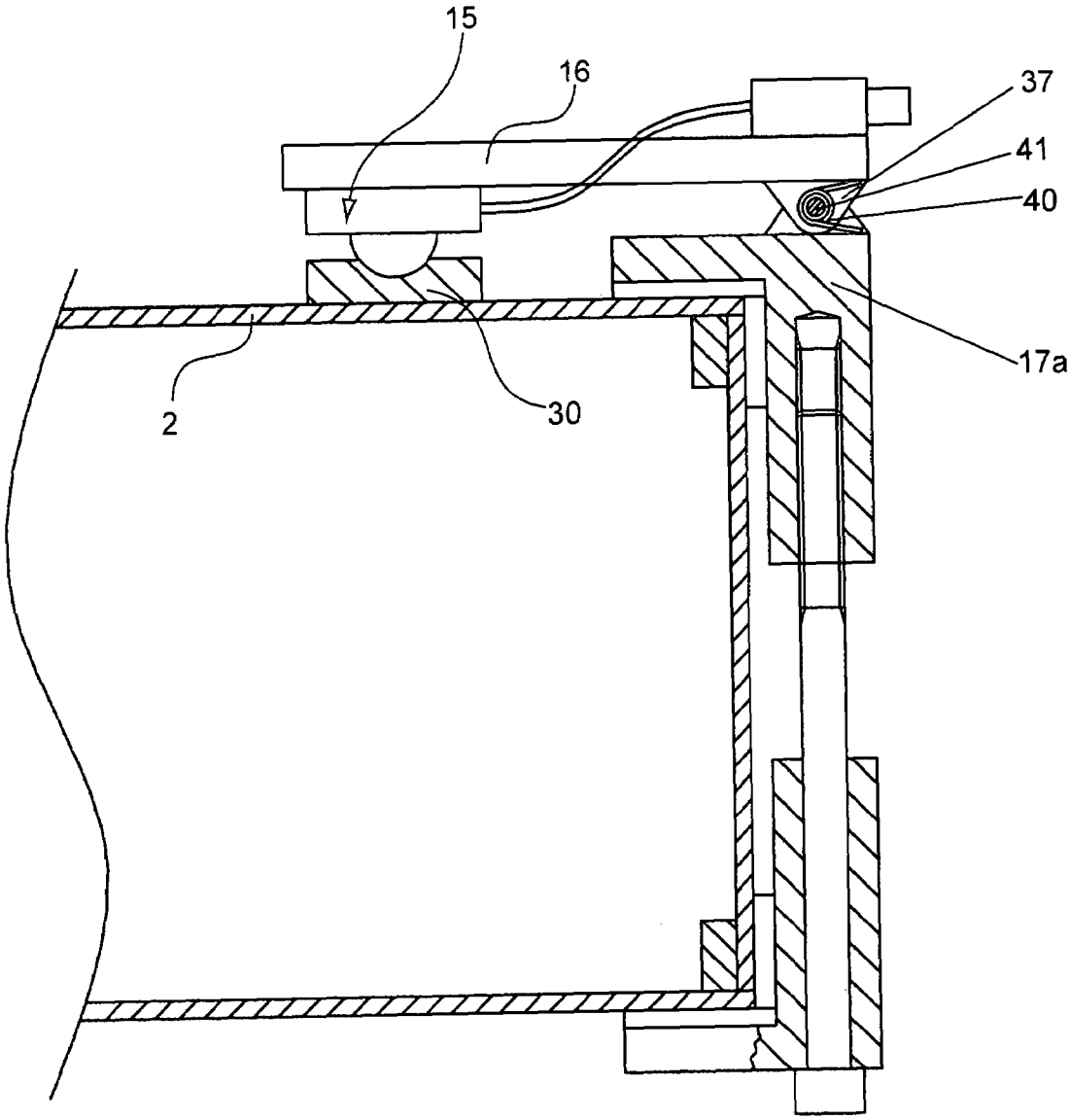
FIG. 10B is a full vertical sectional view of the embodiment shown in FIG. 10A.

In the fixing means shown in FIGS. 10A and B, a fan-like spring (40) is disposed around the hinge (37) part according to the embodiment shown in FIG. 7. Specifically, fan-like spring (40) is wound around a support shaft (41) of the hinge (37). Then, one end of the spring (40) is engaged with the bottom surface of the sensor mounting member (16), while the other end is engaged with the fixing means at a predetermined position. As a result, the tip of the sensor mounting member (16) is always pushed downward, i.e. toward the vibration plate (2) owing to leverage.

In this embodiment, as in other variations, the fixing means may further include a top arm (17*a*), on which the sensor mounting member (16) is mounted. One end of the above-mentioned spring (40) may engage this top arm (17*a*). Additionally, the top arm (17*a*) and the holding member (19) may become removably fixed to the top plate (2) and back plate (3), respectively. Thus, the top arm (17*a*) and the holding member (19) may function somewhat as a "clamp", to secure the vibration sensor mechanism (15) to the main body (1).

Consequently, the sensor mechanism (15) is always fitted on the vibration plate (2) via the vibration transmitter (30) as required. This makes it possible to provide the pickup with the desired beautiful tone at all times.

Embodiment 9

In a further embodiment of the present invention, referring back to FIG. 4B, it is also possible for the sensor mounting member (16) to be made of a spring or other elastic/resilient material, to hold the pickup device on the instrument. This arrangement allows the providing of a suitable force to the top plate (2), by configuring the sensor mounting member (16) to suitably press in a downward direction. For example, if the main body (1) were removed, the sensor mounting member (16) would have a consistent downward angle in the direction of the bottom of the "U" shape.

Such a "spring" arm can effectively control the pressure applied to the top plate (2) and other parts of the instrument, to prevent any damage to the instrument even if the adjusting screw (23) is mistakenly over-tightened. Due to the range of pressured movement afforded by the "spring" arm (16), even if the adjusting screw (23) is over-tightened, the pressure on the sensor (25) (vibration transmitter (30)) can adjust to the appropriate level.

Conversely, an accidental loosening of the adjusting screw (23) will not cause the device to slip off, since the "spring"arm (16) should adjust its pressure on the top plate (2) accordingly.

Also, in place of (or in addition to) the above"spring" arm (16), the holding member (19) side of the sensor mechanism (15) may also be made of a spring or other elastic/resilient material, to provide similar beneficial effects.

Embodiment 10

Figure 10C:
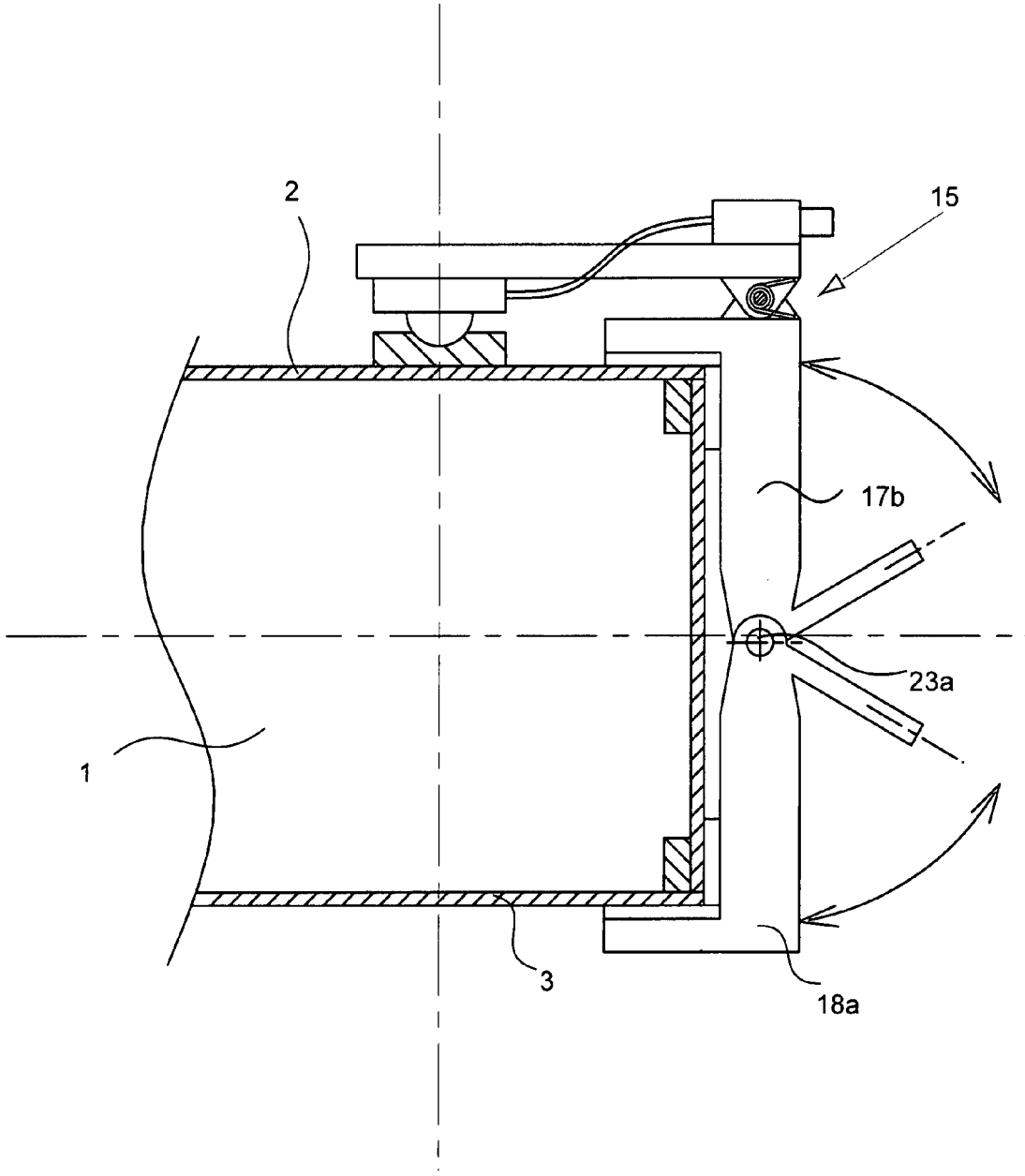
FIG. 10C is a vertical sectional view illustrating the fixing means provided with adjusting means according to another further embodiment.

FIG. 10C shows yet another variation of the present invention. In this embodiment, the sensor mechanism (15) is configured as a clamp or clothespin-like clip, with a top folding portion, as the top arm (17*b*) contacting the top plate (2) and the bottom folding portion (18*a*) contacting the back plate (3). The top folding portion (17*b*) and the bottom folding portion (18*a*) are pivotally attached together at a hinge point (23*a*), so that the two portions are rotatable in the directions indicated by the arrows. A fan-like spring (not shown) or other mechanism known in the art can be applied at the hinge point (23*a*) to constantly force the top and bottom portions (17*b*, 18*a*) together, providing a constant force to adjustably sandwich and hold the main body (1) between those portions, and thereby secure the pickup device to the instrument.

This configuration may especially be suitable for "clipping" the device onto smaller instruments, such as the violin Additionally, besides the "block" like portions shown in the drawing, other suitable variations are possible such as a clip made of bent wires, etc.

Embodiment 11

Figure 11A:
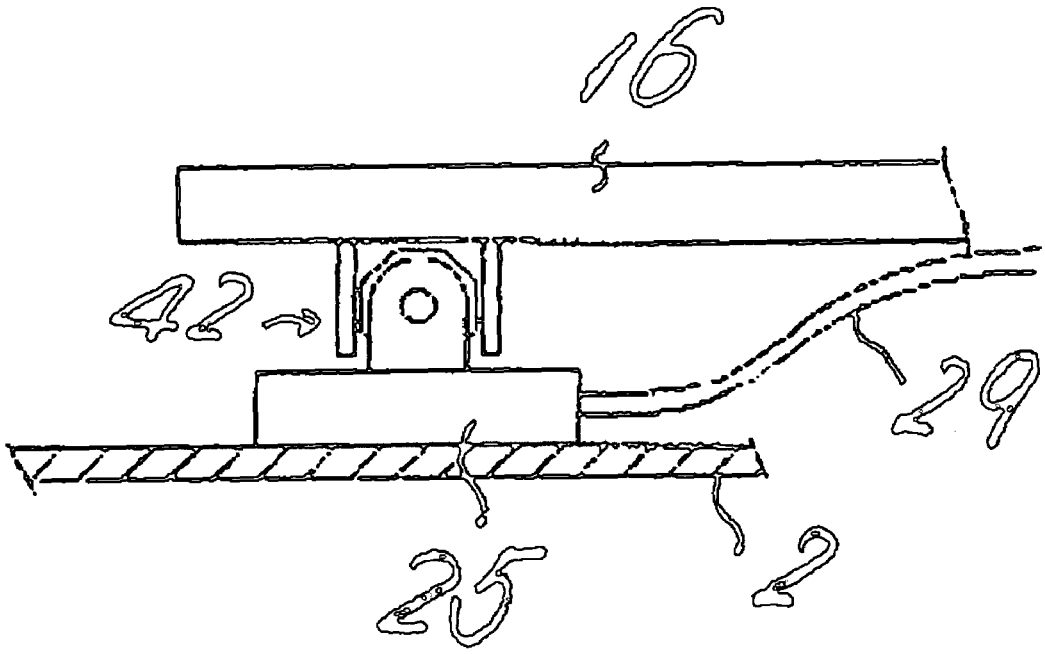
FIG. 11 is a partial vertical sectional view illustrating the fixing means provided with adjusting means according to another further embodiment.
Figure 11B:
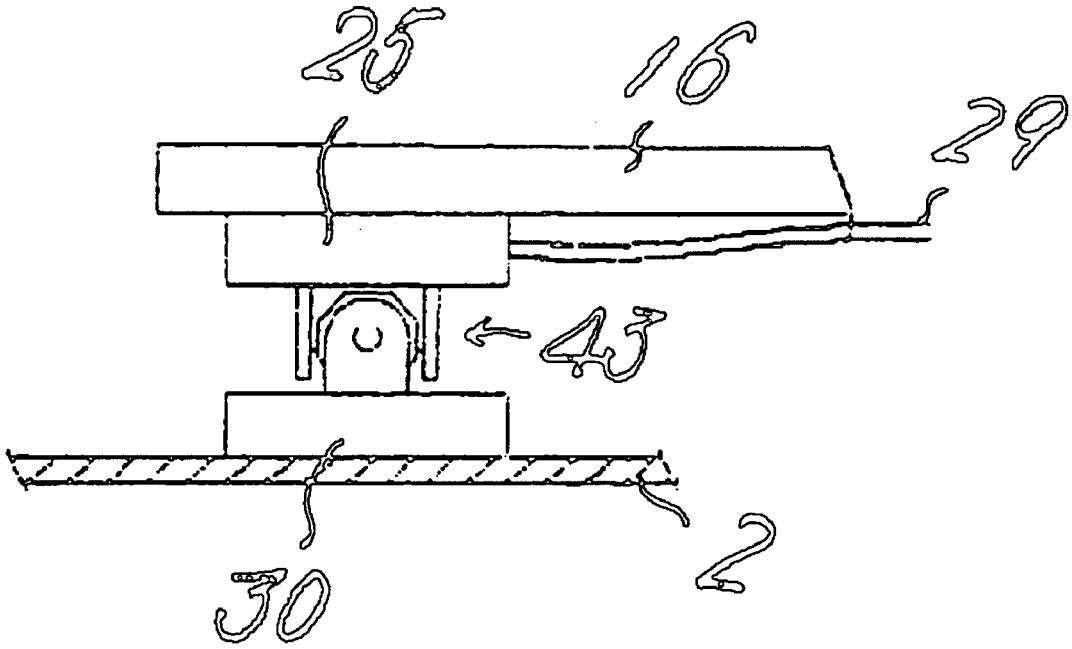

Next, the embodiment shown in FIG. 11 is angle adjusting means for the vibration transmitter (30) and the sensor member (25) or for the sensor mounting member (16) and the sensor member (25) as in the case with the above embodiments. This is called a "universal joint type" and can also realize an angle adjusting mechanism. Specifically, a polygonal latchet plate (42) is attached at the position at which the fan-like spring (40) is provided according to the above embodiments. Plate springs (43) are attached to the fixing means at appropriate positions with respect to the sensor mounting member (16); the plate springs (43) are located at the opposite sides of the latchet plate (42) and abut against the corresponding sides of the latchet plate (42).

To adjust the angle of the sensor mounting member (16), i.e. to adjust the force required to fit the sensor mechanism (15) on the vibration plate (2) via the buffer member (30), the sensor mounting member (16) is pushed toward the vibration plate (2) to locate the latchet plate (42) at the next side. Then, the plate spring (43), the latchet plate (42) is stopped at that position to enable the sensor mounting member (16) to be adjusted to a desired angle.

Embodiment 12

Figure 12:
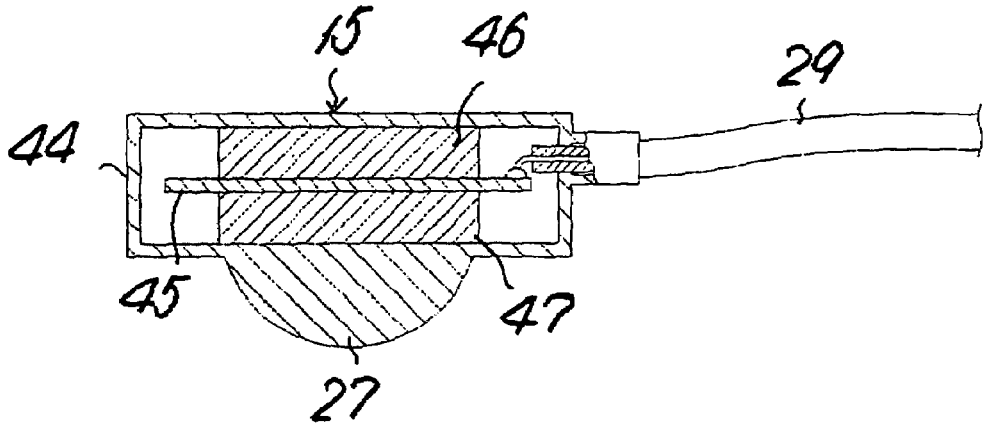
FIG. 12 is a vertical sectional view illustrating a sensor mechanism using two piezoelectric elements.

The sensor mechanism (15) will be described with reference to FIGS. 12 and 13. One (FIG. 12) or more (FIG. 13) piezoelectric elements are generally used in the sensor mechanism (15).

Specifically, in the figures, a casing (44) has a spherical projection on its bottom side as the blastomeric intermediate member (27) and is also acts as a code-side electrode. The casing (44) has a hot electrode plate (45) in its intermediate portion. The hot electrode plate (45) has piezoelectric elements (46) and (47) such as piezoelectric ceramics or polymers closely disposed on its top and bottom surfaces. Furthermore, core wire of the lead (29), an output sheet cable, is welded to the hot electrode plate (45). The shield of the lead (29) is shield connected to the casing (44).

Figure 13:
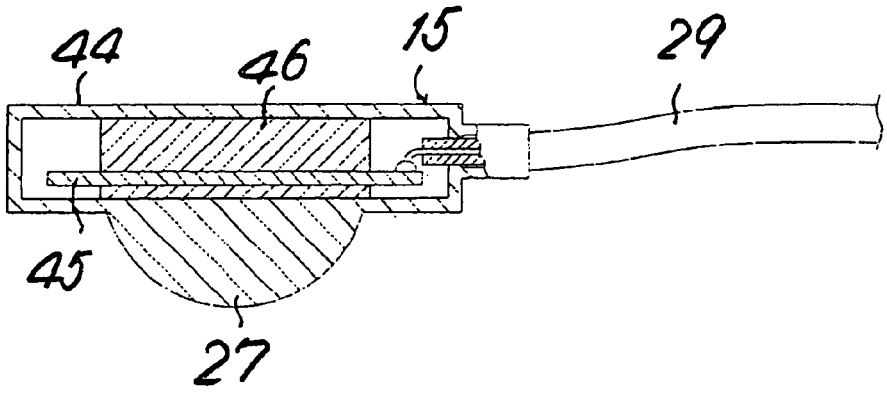
FIG. 13 is a vertical sectional view illustrating a sensor mechanism using one piezoelectric element.

In FIG. 13, the piezoelectric elements (46) are disposed only on the top surface of the hot electrode plate (45). However, it is needless to say that implementations with the upside down are within the technical scope of the present invention.

In the embodiments of the present invention, since the guitar has been cited as an example of a musical instrument, the term "vibration plate (2)" has been used. However, that portion of a samisen or a banjo which corresponds to the vibration plate (2) is formed like a film. Accordingly, in this case, this portion should be called a "vibration film". However, the vibration film is also within the technical scope of the present invention.

What is claimed is:

1. A pickup device for sounds from a stringed instrument having in a main body a top plate provided with a bridge supporting one or more strings, said top plate used to radiate a vibration of each string as a sound wave, wherein said main body further has a back plate oppositely disposed to said top plate, comprising:

a vibration transmitter pressure-contacted to said top plate;

a sensor for receiving a vibration force from the vibration transmitter and converting the vibration force into an electric signal; and a fixing means having a sensor arm with the sensor arranged thereon and an approximately parallel back arm, both arms extending from a squared-off bottom to form a "U" shape wherein spacing between said arms is freely adjustable to pressure-contact, via said sensor, said vibration transmitter at a pressure-contacting point to said exterior surface of said top plate and said back arm to an exterior surface of said back plate, in order to sandwich said main body between the arms and restrain the vibration at said pressure-contacting point, and said fixing means further comprises a top arm, having said sensor arm mounted thereon, wherein spacing between said top arm and back arm is freely adjustable, wherein the top arm and the back arm of the fixing means are pivotally attached together at a hinge point, and a spring member mounted at said hinge point forcibly and removably fixes said top arm to an exterior surface of said top plate and said back arm to an exterior surface of said back plate.

* * * * *